US008486206B2

(12) United States Patent
Litalien et al.

(10) Patent No.: US 8,486,206 B2
(45) Date of Patent: Jul. 16, 2013

(54) METHOD FOR WARM SWAGING AL-MG ALLOY PARTS

(75) Inventors: Pierre Litalien, Grenoble (FR); Alain Legendre, Marcilloles (FR); Dominique Daniel, Lans en Vercors (FR); Guy-Michel Raynaud, Voiron (FR)

(73) Assignee: Constellium France, Paris (FR)

( * ) Notice: Subject to any disclaimer, the term of this patent is extended or adjusted under 35 U.S.C. 154(b) by 2228 days.

(21) Appl. No.: 10/545,003

(22) PCT Filed: Feb. 24, 2004

(86) PCT No.: PCT/FR2004/000407

§ 371 (c)(1),
(2), (4) Date: Sep. 26, 2005

(87) PCT Pub. No.: WO2004/076092

PCT Pub. Date: Sep. 10, 2004

(65) Prior Publication Data

US 2006/0130941 A1 Jun. 22, 2006

(30) Foreign Application Priority Data

Feb. 26, 2003 (FR) ..... 03 02335

(51) Int. Cl.
*C22C 21/06* (2006.01)
*C22F 1/04* (2006.01)

(52) U.S. Cl.
USPC ..... 148/439; 148/440; 148/550; 148/689

(58) Field of Classification Search
USPC ..... 148/689, 550, 439, 440
See application file for complete search history.

(56) References Cited

U.S. PATENT DOCUMENTS

| | | | | |
|---|---|---|---|---|
| 3,212,941 | A | 10/1965 | O'Brien | |
| 4,090,889 | A | 5/1978 | George et al. | |
| 5,735,163 | A * | 4/1998 | Sato et al. | 72/348 |
| 6,013,142 | A * | 1/2000 | Hacias | 148/703 |
| 6,334,916 | B1 * | 1/2002 | Matsumoto et al. | 148/437 |

OTHER PUBLICATIONS

Semiatin, S.L., ASM Handbook-Metals Handbook, 1998, ASM International, 9th Edition vol. 14, 576, 579, 827.*

* cited by examiner

*Primary Examiner* — Roy King
*Assistant Examiner* — Caitlin Kiechle
(74) *Attorney, Agent, or Firm* — Ladas & Parry, LLP

(57) ABSTRACT

A method for the production of swaged aluminum alloy parts, by production of a 0.5 mm-5 mm thick alloy strip made of 1-6 wt. % Mg, <1.2 wt. % Mn, <1 wt. % Cu, <1 wt. % Zn, <3 wt. % Si, <2 wt. % Fe, <0.4 wt. % Cr, Zr<0.3, other elements <0.1 each, total of <0.5, the remainder being Al, cutting a blank from the strip, locally or totally heating the blank at a temperature of 150-350° C. for <30 secs, and swaging the heated blank with the aid of heated tools, at least partially, at a temperature of 150-350° C. in the presence of a lubricant which is compatible with later operations. The swaged parts are automotive body work parts.

21 Claims, 2 Drawing Sheets

METHOD FOR WARM SWAGING AL-MG ALLOY PARTS

This application is a filing under 35 USC 371 of PCT/FR2004/000407 filed Feb. 24, 2004.

FIELD OF THE INVENTION

The invention relates to the manufacturing of highly deformed aluminium alloy parts, particularly made of an Al—Mg type alloy (series 5000 according to standard EN 573-3) used particularly for the automobile industry, by warm drawing, in other words at a temperature of between 150 and 350° C.

DESCRIPTION OF RELATED ART

It is known that the elongation of aluminium alloys at rupture increases at temperatures higher than 150° C., this effect being more marked when the deformation rate is low. Unlike superplastic forming, which takes place at temperatures of more than 450° C. and that requires alloys with a particular very fine-grained microstructure, the warm forming at a temperature of between 150 and 350° C. increase the ductility of conventional alloys, and particularly alloys in the 5000 series.

The first warm drawing tests on aluminium alloys in the automobile industry were carried out in the United States in the 1970s in order to substitute aluminium for steel without modifying tooling. Chrysler's U.S. Pat. No. 4,090,889 deposited in 1976 describes a drawing process for automobile parts at a temperature between 100 and 315° C. made of different types of alloys including alloy 5252-H25. Blanks covered with a graphite-based lubricant are preferably heated by infrared heating. No industrial applications have been made since this time, probably due to the lack of thermal control over the process and due to the difficulty in achieving manufacturing rates similar to what is possible with conventional cold drawing.

SUMMARY OF THE INVENTION

The purpose of this invention is to overcome this disadvantage and to enable warm drawing of aluminium alloy parts, particularly made of an Al—Mg alloy for automobiles with a productivity compatible with the requirements of the automobile industry, either to obtain parts that could not be made cold, or to facilitate manufacturing, particularly by reducing the number of drawing passes, or by using more economic alloys that are difficult to form cold.

The purpose of the invention is a process for manufacturing drawn parts made of an aluminium alloy comprising the following steps:

- manufacturing of a strip with a thickness of between 0.5 and 5 mm of an alloy with composition (% by weight) Mg=1-6, Mn<1.2, Cu<1, Zn<1, Si<3, Fe<2, Cr<0.4, Zr<0.3, other elements <0.1 each and <0.5 total, the remainder being Al,
- cutting a blank from this strip,
- local or complete heating of the blank to a temperature of between 150 and 350° C., for a duration of <30 s,
- drawing of the heated blank using a tool heated at least partially to a temperature of between 150 and 350° C. in the presence of a lubricant compatible with subsequent operations.

The lubricant may be either previously deposited on the cut blank, or sprayed onto the drawing tool immediately before the blank is drawn. Drawing is preferably done in a single pass.

Another purpose of the invention is a drawn part starting from an aluminium alloy blank with the previous composition, comprising areas that are not deformed or slightly deformed, and areas that are highly deformed, in which the least deformed parts have a yield stress $R_{0.2}$ more than that in the most deformed areas by at least 30% (or a Vickers hardness at least 20% more than that in the most deformed areas).

DESCRIPTION OF THE INVENTION

Figure 1:
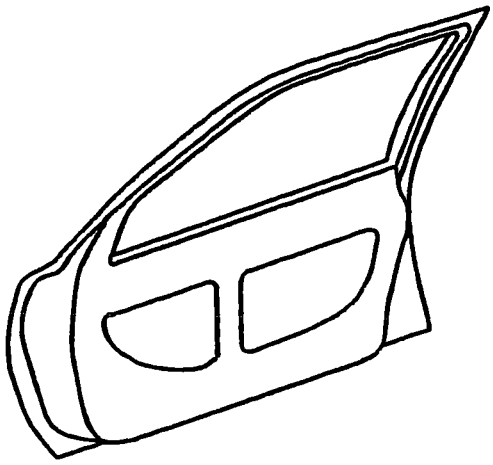
FIG. 1 shows a perspective view of an automobile door lining made using the process according to the invention described in example 1.

The invention is applicable to manufacturing of drawn aluminium alloy parts containing 1 to 6%, and preferably 3.5 to 5% of magnesium. Mg contributes to the mechanical strength of the alloy, in the same way as Cu, Mn or Zn that may be present at contents of 1% for Cu and Zn, and 1.2% for Mn. These alloys are essentially in the 5000 series, for example the 5052, 5083, 5182 or 5754 alloys, but possibly in the 4000 series if the Si content is more than the Mg content, or the 3000 series if the Mn content is slightly more than the Mg content. Such 3000 or 4000 alloys may have been produced by including recycled manufacturing scrap, which makes economic alloys.

The strips may traditionally be obtained by casting plates, hot rolling then cold rolling, but also by continuous casting of strips between two metal belts (belt casting), followed by hot rolling and possibly cold rolling between two cooled rolls (roll-casting) and then cold rolling. For belt casting, it may be technically and economically attractive to use hot rolled strips if possible depending on the thickness.

For traditional casting, Fe is limited to 0.8% but it may be up to 2% in alloys derived from continuous casting. Similarly, silicon may be higher, up to 3% in continuous casting, whereas it is better to limit it to 2% in traditional casting.

The last rolling pass may be done with a textured roll, for example by electron beam treatment (EBT), electro-discharge treatment (EDT) or laser beam treatment, which improves the formability and the surface appearance of the part formed after painting.

The strips may be soft temper (temper O) if very high elongations are necessary to make highly deformed parts that are difficult to drawing, and if requirements for the final mechanical strength are less severe. But one of the advantages of the process according to the invention is to start from a strain hardened or partially annealed temper (H1× or H2× tempers). Apart from the economic advantage of avoiding annealing, this also avoids the appearance of Lüders lines when drawing, which occur when starting from a soft temper. This is an important advantage because, apart from the fact that sufficient indentation resistance is not achieved due to the use of a soft temper, in the past the risk of Lüders lines has prevented the use of Al—Mg alloys for bodywork skin parts to be painted, although they are widely used for non-visible stiffener parts. Note that the same appearance defects also disappear during warm forming of plates with a soft temper, which is an advantage for applications requiring good formability and an attractive appearance but without high mechanical strength, for example as is the case for visible door linings. Finally, the use of the same type of alloy for the skin and stiffeners simplifies recycling.

Strips are then cut into blanks with a shape appropriate for the part to be made. At this stage, the blanks may be coated with a lubricant that is relatively stable at the drawing temperature, and that does not emit toxic fumes at this temperature. The lubricant must also be easy to eliminate during degreasing and compatible with subsequent operations such as welding or bonding without additional surface preparation and with cataphoresis. For example, synthetic ester-based lubricants with a high boiling point and a high flash point can be used containing zinc, sodium or lithium stearates, as lubrication additives, or solid boron nitride type lubricants.

The blanks are then preheated at a temperature of between 150 and 350° C. This preheating must be done sufficiently quickly, taking less than 30 s and preferably less than 20 s or even less than 10 s, to feed the drawing tool at the required rate. If necessary, there may be several preheating stations for feeding the same tool. Preheating may be done homogeneously over the entire blank, but also selectively, thus creating a temperature gradient between different areas of the blank. This localised preheating optimises the mechanical characteristics, either by facilitating forming by a better distribution of deformations, or leading to a final part with heterogeneous mechanical properties adapted to the function of each area in the part formed. For example, the areas that will be most highly deformed may be preheated selectively. In the case of blanks connected end-to-end, preheating can be focused close to the area of the connection to prevent failure in this area during drawing.

It is also possible to start from a strongly strain hardened alloy blank to locally heat the periphery to obtain a part at the end of forming in which the yield stress of the central area that was not heated remains high and for which the periphery was annealed during forming, and consequently has good subsequent crimpability.

An appropriate means of obtaining fast and localised preheating if necessary, is to use contact heating using a heating shoe applied to the blank with the same shape as the area(s) to be heated. Such a device enables an increase in temperature from 20 to 300° C. in less than 15 s, which is sufficient to feed a drawing line at a high rate with a small number of preheating units. Furthermore, if the starting point is a strain-hardened blank that is more sensitive to temperature and exposure duration, this device enables precise control and good reproducibility of the temperatures reached with good control over the cycle time.

When there is a highly deformed area localised in the centre of the part, for example as for a drawing die, the applicant was surprised to observe that the preheating area of the blank should be close to but not actually in the area to be formed, to prevent failure during drawing. Added heat can only come from preheating of the blank and not from the tool, since in this case contact between the tool and the blank is too fast to heat it sufficiently. For example, the blank could be preheated using a heating shim preferably located at a distance of more than 5 mm from the area of the blank corresponding to the highly locally deformed area of the part.

The blank is then transferred to the drawing tool and possible cooling of the blank between the exit from the furnace and the press has to be taken into account to obtain the desired temperature under the press, so that the blank may be slightly heated above the tool temperature.

The preheated blank is then drawn. One of the characteristics of the invention is that the drawing tool is also heated, at least partially, to a temperature between 150 and 350° C. This is obtained by incorporation of electrical resistances into the tool. It is possible to heat only some areas of the tool, preferably the die and the blank holder, rather than the punch. One particularly advantageous arrangement is to have a die in two heated parts separated by an air strip. The result is thus a hot die edge under the cladding of the blank subjected to shrinkage, and a colder die bottom to increase the mechanical strength of the blank at the radii of the die.

Other means can also be used to keep a part of the tool cold close to a hot part, for example by blasting compressed air to dissipate heat on the part to be kept cold, or circulation of a cooling fluid inside this part. The temperature of the different parts of the tool is controlled by regulation.

If the blank was not previously coated by a coat of lubricant as described above, the lubricant can be deposited directly on the drawing tool, for example by spraying a fog. In this way, the exposure time of the lubricant to high temperatures is reduced, which prevents premature degradation during preheating.

The design of the tool must take account of the non-uniform expansion of the tool when the temperature is not uniform. The tool may be treated on the surface to prevent seizure. The forming cycle preferably comprises a single drawing pass followed by finishing passes for trimming or cutting off edges. The drawing rate is at least 6 blows per minute.

The process according to the invention may be used for manufacturing parts with highly deformed areas, particularly parts for automobile construction, both for bodywork skin parts and for structural or stiffening parts.

Due to the optimum combination of preheating of blanks in some areas and heating of the tool with a temperature gradient between different parts, it is possible to obtain visible parts for bodywork skin, for example such as door or roof skins, made from blanks with a thickness of between 0.6 and 1.5 mm, with an exceptional configuration of mechanical properties as a function of the properties required for each portion of the formed part, for example resistance to indentation or behaviour in a crash. The most highly deformed areas in the conventional cold drawing process are the most strain hardened and therefore the hardest areas. Conversely, with the process according to the invention, when the starting point is a strain hardened temper, the most deformed areas, usually around the periphery are in the partially annealed temper during drawing, due to heating of the tool facing these areas, which enables good flow of metal in the tool. Therefore these areas do not harden, while areas that are colder and only slightly deformed keep their high original mechanical strength.

Therefore, for these slightly deformed areas, a yield stress $R_{0.2}$>250 MPa or a Vickers hardness >97 Hv can be achieved, which in particular provides good resistance to indentation and also an excellent surface appearance due to the lack of Lüders lines and a low spring back effect. On the other hand, peripheral areas partially annealed during preheating and drawing are softened and thus have good subsequent crimpability. A combination of good indentation resistance at the centre and good crimpability around the periphery is particularly useful in the case of a panel for outside bodywork such as bonnets, doors and roofs.

For aluminium alloy roofs which can be installed on a steel frame, the process enables the appearance of permanent deformations due to the differential thermal expansion that occurs during this operation, using an alloy with a high yield stress before the cataphoresis step.

For structural and stiffener parts, for example shock absorber beams, connections to the floor, stringers, cradles and door stiffeners made from blanks between 2 and 5 mm thick, it becomes possible to achieve drawing depths that cannot be obtained cold, with a lower spring back effect and a higher mechanical strength.

In some cases, particularly for door linings, the high mechanical strength of slightly deformed parts, for example such as the strip under the window frame, can be useful in the case of a frontal shock and thus reduces the weight of the profiled stiffener in this area.

Thus, due to the use of plates in the strain hardened temper, the process according to the invention enables a wide adjustment range to reach the final shape with the required characteristics. By combining an intermediate metallurgical temper (Hn4 or Hn2) and heating of the blank and the appropriate tools, it is possible to temporarily reduce the yield stress during forming. After cooling, the high mechanical strength of the part is restored, only slightly degraded compared with the original blank. This choice is very useful when it is required to mark details on a finished visible part, while maintaining a high yield stress after forming.

The process according to the invention can feed a drawing press at a rate of at least 6 parts per minute. It can optimise mechanical properties for forming better than is possible with cold drawing, and leads to mechanical property gradients for formed products, that contribute to improving the service function of the final part (for example its crash or indentation resistance) or to simplify subsequent assembly operations on the formed part (for example crimping).

Finally, the blank preheating step in the process according to the invention assures good thermal stability of the process while limiting heat exchanges between the blank and the tool, and also simplifies the tool heating device by making these tools less sensitive to temperature variations during forming at high rate.

EXAMPLES

Example 1

Deep Drawing of a Door Lining

The door lining shown in FIG. 1 comprising an integrated window frame with a box depth equal to at least 100 mm is made using the process according to the invention in a single drawing pass. The radii of curvature used in the part are tight (up to 6 to 8 mm). The openings are subsequently trimmed and cut using traditional cutting tools.

The starting point is a parallelogram shaped blank made of pre-lubricated 1 mm thick 5754-O alloy with an aqueous emulsion that, after evaporation, leaves a dry mineral oil based film (paraffin in C14 to C28).

This part cannot be made using a conventional drawing process (cold) in a single pass; breakages occurs at the radius of the punch, where the metal is highly stressed in bending under tension in plane deformation. The metal is then no longer strong enough to entrain material pressed by the blank holder. A reduction in the pressure of the blank holder causes the formation of folds.

Figure 2:
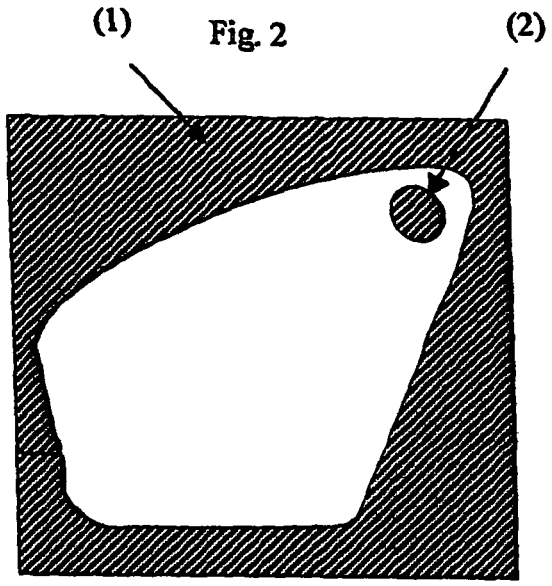
FIG. 2 shows the preheated area of the blank used in examples 1 and 2.
Figure 3:
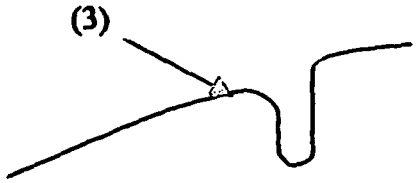
FIG. 3 shows a sectional view of the drawing die at the corner of the part in example 2.

Application of the process according to the invention consists of preheating the periphery of the blank corresponding to the area (1) in FIG. 2 that will be located under the blank holder, so as to reduce its yield stress and thus facilitate metal flow in the tool, even at high blank holding pressures. However, the centre of the blank remains cold, particularly the area that is in bending under tension on the radius of the punch, to avoid degrading its mechanical strength.

The blank is preheated by contact for 10 s. A shim with the same shape as the area to be heated is screwed under a heating plate, so as to apply localised heating. The blank is then pressed in contact with this shim and its temperature is thus increased to 250° C. FIG. 2 illustrates the shape of the shim screwed under the heating plate. The fast heating time (10 s) assures that the press is fed at the correct rate, and maintains a temperature gradient in the blank.

The blank is ejected under the drawing press, which is a 900-tonne hydraulic press. The drawing tool is formed of four elements, a punch, a blank holder and a 2-part die. The first, called the die ring, is facing the blank holder. The second, called the die bottom is facing the punch. Only the die ring and the blank holder are heated to 250° C. using U resistances along the die entry line. The bottom of the die, isolated from the die ring by an air strip, and the punch remain at a temperature less than 130° C. throughout the duration of the test.

The blank is drawn at a punching speed of 200 mm/s. The formed part is then ejected from the press. The maximum possible rate is 6 to 10 blows per minute, which is the rate of a conventional drawing line for a steel door lining. A combination of localised preheating of the blank and heating of the tool limits heat exchanges between the blank and the tool, and therefore enables thermal stability of the process.

Example 2

Door Lining With Drawing Die

2a—A part similar to that in example 1 is made, but with a particularly critical drawing die (3) at the corner of a window, with the geometry shown in FIG. 2. Applying the same conditions as in example 1, in other words by preheating the blank only in the peripheral area (1) shown in FIG. 2, a rupture appears at the end of the travel distance during formation of the drawing die (3). The preheating of the blank was modified in an attempt to prevent this rupture by adding a shim (2) under the preheating shoe, so as to preheat a corner area in addition to the periphery to 300° C. as shown in FIG. 2. It can be seen that if the shim covers the entire corner area, the metal becomes too soft, and the part cannot be taken out without breakage. However, if heating is only done nearby on each side of the area in which the drawing die (2) will be located at a distance of more than 5 mm, the part can be taken out without breakage. In such a case, it would not have been possible to heat this area using a tool since the contact time is too short to heat it to 300° C. A strong sensitivity to the position of the shim (2) is also observed. By moving the complementary heating area by 2 cm towards the periphery, a break is observed in the drawing die radius. By moving it by 2 cm inwards, a break is observed inside the glazed area of the window.

The combination between optimised preheating of the blank and heating of the tool makes it possible to stamp this difficult part at a rate of 6 parts per minute, while maintaining thermal stability of the process.

2b—The same operations were carried out as in example 2a, but using a 5052-O alloy derived from continuous casting of strips between rolls (twin-roll casting). A part can be formed without breakage using the same process parameters, which is impossible using this material cold.

2c—The same operations as in example 2b are repeated but using a 5052 alloy derived from continuous twin-belt casting. The result is identical.

Example 3

Door Lining From a Strain Hardened Blank

The same part is made as in example 1, but starting from a 5182-H18 blank for which the yield stress is more than 300 MPa and its Vickers hardness is more than 110 Hv. The blank is pre-lubricated with an emulsion saturated in lithium stearate.

The blank is too hard to be formed. The role of preheating is to facilitate deformation in the areas that will be highly deformed, in other words peripheral areas. Therefore, these areas are preheated by the same device as above but to a temperature of 350° C. Fast and local preheating maintains a large temperature gradient within the blank (250° C. on 10 cm).

The tools are heated to 300° C. Simple regulation maintains the tools at 300° C. since the heat exchange with the slightly warmer blank is lower. Heating of the deformed parts during forming reduces the flow stress, which means that drawing can be completed successfully, since the softened metal can flow in the tool and be shaped.

On the other hand, the window strip area is only slightly deformed and is not heated and maintains a high mechanical strength ($R_m$>340 MPa, or Vickers hardness >105 Hv) which is useful in the case of a frontal shock. Therefore the weight of the stiffening profile for this area can be reduced without any loss of global performance.

Example 4

Bodywork Skin Part: Roof

A roof made of 5182 alloy is made by warm drawing using the process according to the invention. One of the working properties of this type of part is its resistance to indentation, which is directly related to the yield stress. Since 5000 alloys are not structurally hardened, unlike 6000 alloys that are hardened when paint is baked, the yield stress of the part must be sufficiently high after forming to satisfy the specification. This is why the starting point is a 1 mm thick blank made of a highly strain hardened alloy, 5182 in the H14 temper, for which the yield stress is more than 240 MPa, namely a Vickers hardness >95 Hv. This type of blank cannot be formed using a conventional cold drawing process.

The same lubricant is used as in example 3.

The blank is preheated for 10 s under an iron that comes into contact with the blank assembly. Unlike example 1, it is preferable to heat the blank assembly to 275° C. to have better control over the final geometry and to clearly mark lines on the part.

The tool comprises 3 elements: a punch, a blank holder and a die. The heating cartridges are inserted into the elements to increase their temperature uniformly to 275° C. Drawing is done on the same 900 t hydraulic press as in the previous examples, at a punching speed of 200 mm/s. The rate is 6 parts per minute.

Test pieces are taken from the formed part and are then passed in a drying oven to simulate a paint baking cycle (hold at 180° C. for 20 minutes). Tension tests show that a yield stress of more than 220 MPa is maintained, which is equivalent to a hardness of >90 Hv which is sufficient to obtain a satisfactory indentation resistance for a 1 mm thick plate.

Finally, this high yield stress prevents the appearance of permanent defects that could occur during baking of the paint. If the part is fixed on a steel frame, the difference in the coefficient of the thermal expansion causes higher expansion of the roof, and therefore a risk of buckling. If the yield stress of the roof is low, this buckling can cause irreversible deformations (plastification), but this disappears if the yield stress is high.

Example 5

Bodywork Skin Part: External Bonnet Panel

As in example 4, a strain hardened 5182 alloy is used to form an external opening panel (bonnet). Appearance and resistance to indentation criteria are the same as above. However, the external panel must be crimped onto a lining part. Therefore, the contours of the panel must be crimpable, which is why a formable blank is necessary at this location. The areas that will be crimped are located under the blank holder during the first drawing pass.

Therefore, the initial temper is a highly strain hardened H18 temper that is very sensitive to the forming temperature.

Local preheating to 300° C. is applied on the peripheral area of the blank, partly to facilitate drawing and partly to soften the area that will be crimped later. As in example 3, fast contact heating maintains a high temperature gradient within the part.

Drawing tools are uniformly heated to 300° C. On the contact surface of the blank holder, this causes continued softening of the areas that will be crimped, initiated during preheating, while heating in the punch area helps to temporarily lower the yield stress and to clearly mark the shapes of the part.

Therefore the final product is a panel in which the central area has lost very little of its mechanical characteristics before drawing due to its very short exposure (only during drawing) to 300° C.; the result is thus a yield stress $R_{0.2}$>250 MPa or a Vickers hardness >97 Hv. Therefore this area has good resistance to indentation. On the other hand, the peripheral area has a lower yield stress, $R_{0.2}$<160 MPa or a Vickers hardness <75 Hv. Therefore it is very formable and can be crimped onto a lining part.

The invention claimed is:

1. Process for manufacturing drawn parts made of an aluminum alloy, comprising the steps of:

manufacturing of a strip with a thickness of between 0.5 and 5 mm of an alloy with composition consisting essentially of, in % by weight, Mg=1-6, Mn<1.2, Cu<1, Zn<1, Si<3, Fe<2, Cr<0.4, Zr<0.3, other elements <0.1 each and <0.5 total, the remainder being Al;

cutting a blank from the strip;

heating the blank, locally or completely, for a duration of <30 s, to a temperature of between 150 and 350° C.; and drawing the heated blank using a tool heated at least partially to a temperature of between 150 and 350° C., in the presence of a lubricant compatible with subsequent operations.

2. Process according to claim 1, wherein the strip has an initial strain hardened temper or is partially annealed.

3. Process according to claim 1, wherein the initial strip is a 5182, 5052, 5083 or 5754 alloy.

4. Process according to claim 1, wherein the strip is obtained by continuous casting.

5. Process according to claim 4, wherein the strip is obtained by continuous belt casting, hot rolled and used in a temper obtained thereby.

6. Process according to claim 1, wherein the lubricant contains a lithium and sodium stearate emulsion in water.

7. Process according to claim 1, wherein the lubricant is deposited on the cut blank.

8. Process according to claim 1, wherein the lubricant is deposited on the tool just before drawing.

9. Process according to claim 1, wherein the blank is heated by contact using a heating shoe having a shape of the area to be heated.

10. Process according to claim 1, wherein heating of the blank is made in a peripheral area.

11. Process according to claim 9, wherein the blank is heated locally using a shim fixed on the heating shoe.

12. Process according to claim 1, wherein the part comprises a highly deformed localized area in a center portion thereof, and the preheated area is located at a distance of more than 5 mm from the area of the blank corresponding to the highly locally deformed area.

13. Process according to claim 1, wherein the drawing tool comprises a punch, a blank holder, a die ring facing the blank holder and a die bottom facing the punch, and only the die ring and the blank holder are heated.

14. Process according to claim 1, wherein the drawing is done in a single pass.

15. Drawn part obtained from a blank having a thickness of between 0.5 and 5 mm of an alloy consisting essentially of, in % by weight, Mg=1-6, Mn<1.2, Cu<1, Zn<1, Si<3, Fe<2, Cr<0.4, Zr<0.3, other elements <0.1 each and <0.5 total, the remainder being Al, and comprising areas that are not deformed or slightly deformed, and areas that are highly deformed, wherein the yield stress $R_{0.2}$ of the least deformed areas is at least 30% more than the yield stress $R_{0.2}$ in the most deformed areas, or the Vickers hardness Hv of the least deformed areas is at least 20% more than the Vickers hardness Hv in the most deformed areas.

16. Part according to claim 15, which is an automobile bodywork skin part.

17. Part according to claim 15, comprising softened areas for subsequent forming.

18. Part according to claim 17, which is a part to be crimped on a lining.

19. Part according to claim 15, which is an automobile door lining.

20. Part according to claim 19, comprising a strip area located under a window, wherein resistance to rupture $R_m$ of the strip area is more than 340 MPa or hardness of the strip area is more than 105 Hv.

21. Part according to claim 16, which is a roof fixed onto a steel frame.

* * * * *